US010646005B2

(12) United States Patent
Ogura

(10) Patent No.: US 10,646,005 B2
(45) Date of Patent: May 12, 2020

(54) SLIDE FASTENER WITH BLOCKING ELEMENT

(71) Applicant: YKK Corporation of America, Marietta, GA (US)

(72) Inventor: Suguru Ogura, Taipei (TW)

(73) Assignee: YKK Corporation of America, Marietta, GA (US)

( * ) Notice: Subject to any disclaimer, the term of this patent is extended or adjusted under 35 U.S.C. 154(b) by 98 days.

(21) Appl. No.: 16/119,080

(22) Filed: Aug. 31, 2018

(65) Prior Publication Data

US 2020/0069006 A1 Mar. 5, 2020

(51) Int. Cl.
*A44B 19/24* (2006.01)
*A44B 19/08* (2006.01)

(52) U.S. Cl.
CPC ..... *A44B 19/24* (2013.01); *A44B 19/08* (2013.01)

(58) Field of Classification Search
CPC ..... A44B 19/24; A44B 19/08
See application file for complete search history.

(56) References Cited

U.S. PATENT DOCUMENTS 2,578,442 A * 12/1951 Morin ..... A44B 19/386 24/404
2,701,401 A * 2/1955 Dorman ..... A44B 19/36 24/433
4,858,284 A * 8/1989 Yoshimura ..... A44B 19/36 24/433
5,400,482 A * 3/1995 Oda ..... A44B 19/36 24/433
6,453,521 B1 * 9/2002 Dischler ..... A44B 19/14 24/403
6,604,263 B1 8/2003 Louis
D632,218 S 2/2011 Yamamoto et al.
8,800,118 B2 8/2014 Takasawa et al.
8,925,161 B2 1/2015 Takasawa et al.
2004/0187277 A1 * 9/2004 Akashi ..... A44B 19/301 24/584.1

FOREIGN PATENT DOCUMENTS

WO 2013108098 A1 7/2013

* cited by examiner

*Primary Examiner* — Robert Sandy
*Assistant Examiner* — Rowland Do
(74) *Attorney, Agent, or Firm* — Meuiner Carlin and Curfman LLC

(57) ABSTRACT

Various implementations include a slide fastener that has a blocking element on one stringer that prevents engagement compatibility with standard elements on the other stringer. For example, at least one blocking element is coupled to a first stringer, and first and second blocking coupling elements are coupled to a second stringer. The contour of the blocking element and the contour of the blocking coupling elements are different from the contour of the standard elements on the stringers such that the standard elements do not engage with the blocking element or the blocking coupling elements in an alternating arrangement. However, the contour of the blocking element and contour of the blocking coupling elements allow for the engagement of the blocking element with the blocking coupling elements in an alternating arrangement.

30 Claims, 10 Drawing Sheets

SLIDE FASTENER WITH BLOCKING ELEMENT

BACKGROUND

Slide fasteners include first and second stringers. Each stringer includes a tape and a plurality of standard elements disposed along an inner edge of the tape. The tapes lie within a fastening plane, and the inner edges face each other within the fastening plane. A slider is slidably coupled to at least one of the stringers. The slider couples the plurality of elements of the stringers when the slider is urged in a first sliding direction within the fastening plane and decouples the element when the slider is urged in a second sliding direction within the fastening plane. The first sliding direction is opposite the second sliding direction. The standard elements have the same contour and are engagable with each other when the slider is urged past opposing elements.

With this arrangement, suppliers of a replacement product that includes one or more stringers of the slide fastener may be able to compete for sales with an original supplier of the product that includes the slide fastener. However, the original supplier and/or the purchaser may wish to prevent the other suppliers from providing the replacement product. Accordingly, there is a need in the art to provide a modified slide fastener that prevents engagement compatibility with standard elements.

BRIEF SUMMARY

Various implementations include a slide fastener that comprises first and second stringers and a slider. Each of the first and second stringers comprises a tape and a plurality of elements disposed on an inner edge of the tape. The tape is within a fastening plane, and the inner edges face each other within the fastening plane. The slider is slidably coupled to at least one of the stringers. The slider couples the plurality of elements of the stringers when the slider is urged in a first sliding direction within the fastening plane and decouples the plurality of elements when urged in a second sliding direction within the fastening plane. The second sliding direction is opposite the first sliding direction. The plurality of elements of the first stringer and the second stringer comprises a plurality of standard elements. The plurality of elements of the first stringer further comprises a blocking element. And, the plurality of elements on the second stringer further comprises first and second blocking coupling elements. Engagement portions of at least a portion of the standard elements on the first tape engage between engagement portions of at least a portion of the standard elements on the second tape in an alternating arrangement in the sliding directions, and vice versa, when the slider is urged over the standard elements in the first sliding direction. Engagement portions of the blocking element engage between engagement portions of the first and second blocking coupling elements when the slider is urged over the blocking element and the blocking coupling elements in the first sliding direction. A contour of the blocking element and a contour of the blocking coupling elements are different from a contour of the standard element such that the engagement portions of the standard elements on the second tape do not engage with the engagement portions of the blocking element on the first tape in an alternating arrangement in the sliding directions. And, the engagement portions of the standard elements on the first tape do not engage with the engagement portions of the blocking coupling elements on the second tape in an alternating arrangement in the sliding directions.

In some implementations, each element has a base portion coupled to first and second surfaces of the respective tape, and the base portions of adjacent elements on each tape are spaced apart along the respective tape by a gap width.

In some implementations, the base portion of the blocking element has a blocking base width as measured in the sliding directions, the base portion of each standard element has a standard base width as measured in the sliding directions, and the blocking base width is at least twice the standard base width plus the gap width.

In some implementations, a width of the base portions of the first and second blocking coupling elements and the gap width therebetween is at least three times the standard base width plus twice the gap width.

In some implementations, the engagement portions of the blocking element comprise a first engagement portion and a second engagement portion. The first and second engagement portions extend from the inner edge of the first tape and the base portion of the blocking element and are coupled together along the fastening plane. Each engagement portion has a first edge that faces the first sliding direction, a second edge that faces the second sliding direction, and a distal edge that extends between the first and second edges and faces the inner edge of the second tape. At least one of the first edges of the blocking element defines a recess and protrusion, and at least one of the second edges of the blocking element defines a chamfered surface that extends between the base portion of the blocking element and the respective distal edge of the engagement portions of the blocking element.

In some implementations, the first edge of the first engagement portion of the blocking element defines a first recess and protrusion, the second edge of the first engagement portion of the blocking element defines a first chamfered surface, the first edge of the second engagement portion of the blocking element defines a second chamfered surface, and the second edge of the second engagement portion of the blocking element defines a second recess and protrusion. In some implementations, a first engagement portion of each blocking coupling element defines a neck portion and a head portion, and a second engagement portion of each blocking coupling element has a triangular shape as viewed from the fastening plane. And, in some implementations, the triangular shape is asymmetrical and comprises a long edge and a short edge. The long edge faces one of the first or second sliding direction, and the short edge faces the other of the first or second sliding direction. And, in some implementations, each of the first and second blocking coupling element has a guide portion that is continuous with the long edge.

In some implementations, the plurality of elements further comprises at least one intermediate transition element and/or at least one end transition element. For example, in some implementations, a first engagement portion of each end transition element defines a chamfered surface and a recess, and a second engagement portion of each end transition element defines a neck portion and a head portion. And, in some implementations, each engagement portion of each end transition element comprises a first edge and a second edge. The first edges face the first sliding direction, and the second edges face the second sliding direction. One of the first or second edges of the respective engagement portion of each end transition element defines the chamfered surface and the other of the first or second edges of the respective engagement portion of each end transition element defines the recess. And, in some implementations, one engagement portion of each intermediate transition element defines a triangular shape as viewed from the fastening plane, and another of engagement portion of each intermediate transition element defines a neck portion and a head portion.

In some implementations, the first tape comprises a retaining box or a pin coupled to an end of the first tape along the inner edge of the first tape, and the second tape comprises the other of a retaining box or a pin coupled to an end of the second tape along the inner edge of the second tape. The pin is engaged through the slider and into the retaining box, and the slider is movable in the first sliding direction away from the engaged retaining box and pin and ends of the tapes to engage the plurality of elements.

Other various implementations include a stringer for use in a slide fastener. The stringer comprises a tape and a plurality of elements disposed on an edge of the tape. The tape is within a fastening plane. Each of the plurality of elements comprises a base portion and first and second engagement portions. The base portion is coupled to first and second surfaces of the tape, and the first and second engagement portions extend from the base portion and the edge of the tape. The first and second engagement portions are coupled together along the fastening plane. The plurality of elements comprises a plurality of standard elements and a blocking element. A contour of the engagement portions of the blocking element are different from a contour of the engagement portions of the standard element such that the engagement portions of the standard elements on another tape do not engage with the engagement portions of the blocking element in an alternating arrangement. And, at least one of the engagement portions of the blocking element has a chamfered surface.

In some implementations, a slider is slidably coupled to the stringer. The slider is slidable in a first sliding direction and a second sliding direction along the edge of the tape.

In some implementations, the base portions of adjacent elements on the tape are spaced apart along the respective tape by a gap width.

In some implementations, the base portion of the blocking element has a blocking base width as measured in the sliding directions. The base portion of each standard element has a standard base width as measured in the sliding directions, and the blocking base width is at least twice the standard base width plus the gap width.

In some implementations, the first and second engagement portions each have a first edge, a second edge, and a distal edge. The first and second edges extend between the base portion and the distal edge. One of the first or second edges of the first or second engagement portion defines a recess and protrusion, and the other edge of the first or second edges of the respective first or second engagement portion defines a chamfered surface that extends between the base portion of the blocking element and the respective distal edge of the blocking element.

In some implementations, the first edge of the first engagement portion defines a first recess and protrusion, the second edge of the first engagement portion defines a first chamfered surface, the first edge of the second engagement portion defines a second chamfered surface, and the second edge of the second engagement portion defines a second recess and protrusion.

In some implementations, the plurality of elements comprises at least one end transition element. One of the first or second engagement portion of each end transition element defines a chamfered surface and a recess, and the other of the first or second engagement portion of each end transition element defines a neck portion and a head portion.

In some implementations, one of the first or second edges of the respective first or second engagement portion of each end transition element defines the chamfered surface, and the other of the first or second edges of the respective first or second engagement portion of the respective end transition element defines the recess.

In some implementations, the plurality of elements comprises at least one intermediate transition element, one of the first or second engagement portion of each intermediate transition element defines a triangular shape as viewed from the fastening plane, and the other of the first or second engagement portion of each intermediate transition element defines a neck portion and a head portion.

In some implementations, the tape comprises a retaining box or a pin along the edge of the tape adjacent an end of the tape.

Other various implementations include a stringer for use in a slide fastener. The stringer comprises a tape and a plurality of elements disposed on an edge of the tape. The tape is within a fastening plane. Each of the plurality of elements comprises a base portion and first and second engagement portions. The base portion is coupled to first and second surfaces of the tape, and the first and second engagement portions extend from the base portion and the edge of the tape. The first and second engagement portions are coupled together along the fastening plane. The plurality of elements comprises a plurality of standard elements and first and second blocking coupling elements. A contour of the engagement portions of the blocking coupling elements are different from a contour of the engagement portions of the standard element such that the engagement portions of the standard elements on another tape do not engage with the engagement portions of the blocking coupling elements in an alternating arrangement. At least one of the engagement portions of the blocking coupling elements has a chamfered surface.

In some implementations, a slider is slidably coupled to the stringer. The slider is slidable in a first sliding direction and a second sliding direction along the edge of the tape.

In some implementations, the base portions of adjacent elements on the tape are spaced apart along the respective tape by a gap width.

In some implementations, the base portion of each standard element has a standard base width as measured in the sliding directions, and a total base width of the base portions of the first and second blocking coupling elements and the gap width therebetween is at least three times the standard base width plus twice the gap width.

In some implementations, one of the first or second engagement portion of each blocking coupling element defines a neck portion and a head portion, and the other of the first or second engagement portion of each blocking coupling element has a triangular shape as viewed from the fastening plane.

In some implementations, the triangular shape is asymmetrical. The triangular shape comprises a long edge and a short edge. The long edge faces one of the first or second sliding direction, and the short edge faces the other of the first or second sliding direction.

In some implementations, each of the first and second blocking coupling element has a guide portion that is continuous with the long edge.

In some implementations, the plurality of elements comprises at least one end transition element. One of the first or second engagement portion of each end transition element defines a chamfered surface and a recess, and the other of the first or second engagement portion of each end transition element defines a neck portion and a head portion.

In some implementations, one of the first or second edges of the respective first or second engagement portion of each engagement portion of each end transition element defines the chamfered surface, and the other of the first or second edges of the respective first or second engagement portion of the respective end transition element defines the recess.

In some implementations, the plurality of elements comprises at least one intermediate transition element. One of the first or second engagement portion of each intermediate transition element defines a triangular shape as viewed from the fastening plane, and the other of the first or second engagement portion of each intermediate transition element defines a neck portion and a head portion.

In some implementations, the tape comprises a retaining box or a pin along the edge of the tape adjacent an end of the tape.

BRIEF DESCRIPTION OF THE DRAWINGS

Example features and implementation are disclosed in the accompanying drawings. However, the present disclosure is not limited to the arrangements and instrumentalities shown. Furthermore, various features may not be drawn to scale.

DETAILED DESCRIPTION

Figure 1:
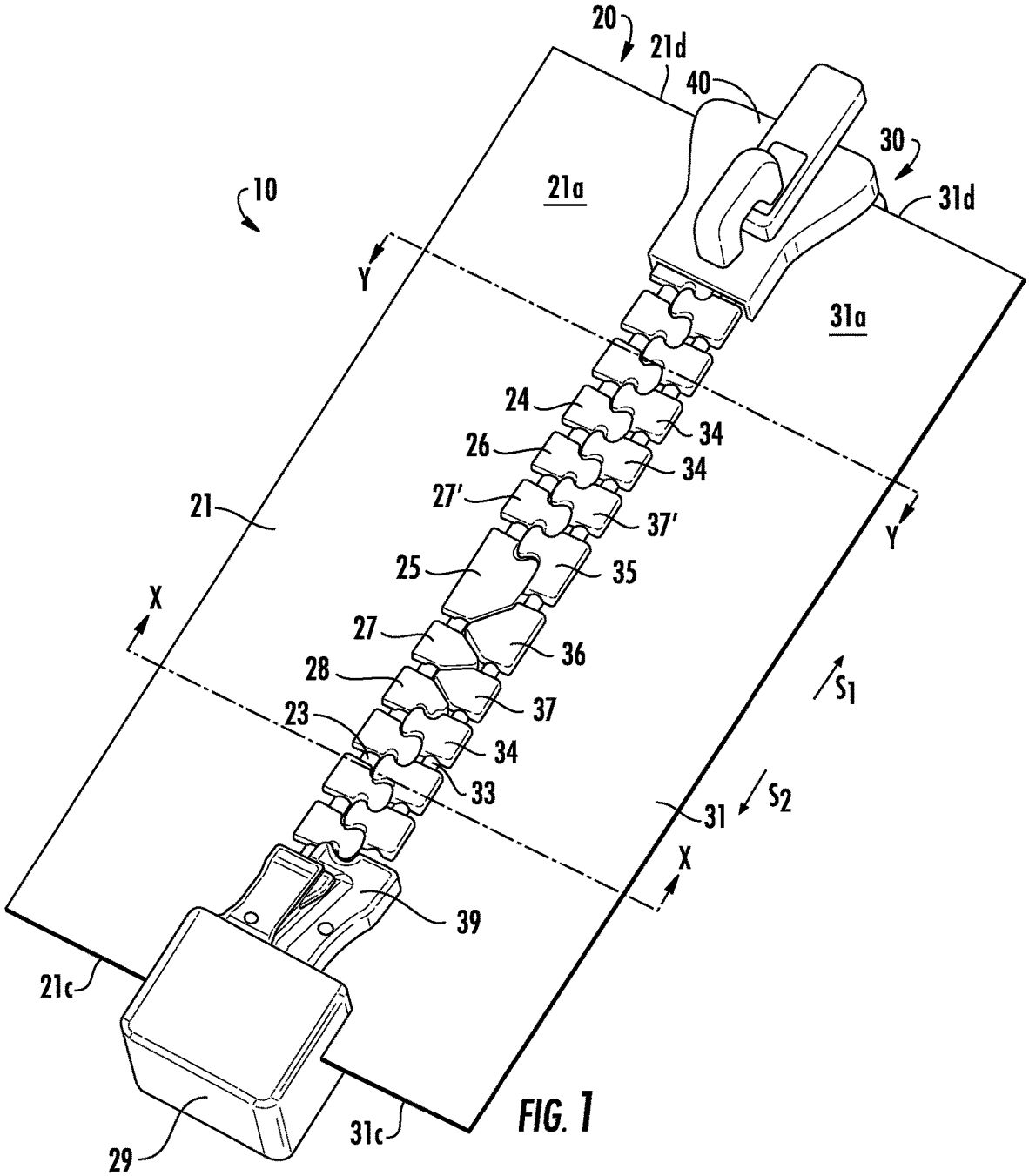
FIG. 1 illustrates a perspective view of first surfaces of stringers of a slide fastener having a plurality of elements coupled together, according to one implementation.

Various implementations include a slide fastener that has at least one blocking element on one stringer that prevents engagement compatibility with standard elements on the other stringer. For example, the slide fastener includes a first stringer, a second stringer, and a slider that is slidably coupled to at least one of the stringers. Standard elements are disposed on the inner edges of the stringers. The standard elements on the first stringer engage, or interlock between, the standard elements on the second stringer, and vice versa, in an alternating arrangement when the slider is urged over the elements in the first sliding direction. The elements disengage when the slider is urged over the elements in the second sliding direction.

At least one blocking element is coupled to the first stringer, and first and second blocking coupling elements are coupled to the second stringer. The contour of the blocking element and the contour of the blocking coupling elements are different from the contour of the standard elements such that the standard elements on the second stringer do not engage with the blocking element in an alternating arrangement and standard elements on the first stringer do not engage with the blocking coupling elements in an alternating arrangement. However, the contour of the blocking element and contour of the blocking coupling elements allow for the engagement of the blocking element between the blocking coupling elements. Thus, the first and second stringers can be coupled together, but the first stringer cannot be coupled with a second stringer that does not include the blocking coupling elements opposite the blocking element, and vice versa. The stringers may not be able to be coupled at all or without compromising the integrity of the couplings (e.g., having an area(s) of non-engagement, area(s) more susceptible to separation, or causing the stringers to twist relative to each other).

Alternating arrangement refers to having the engagement portions of an element on one tape being disposed between, in the sliding directions, the engagement portions of two adjacent elements on the other tape, and vice versa. When the elements on each stringer (except for the retaining box element and end stop elements) are engaged in an alternating arrangement and the fastening planes of each element are coplanar, the elements are properly engaged, or coupled. Thus, if two or more adjacent elements on a first tape are disposed between two adjacent elements on a second tape and no element from the second tape is between the elements on the first tape, or vice versa, then the elements are not engaged in an alternating arrangement. In such an arrangement, the elements are susceptible to becoming uncoupled if a transverse force relative to the fastening plane is applied to the elements. Or, if an element on the first tape is not disposed between two elements on the second tape, or vice versa, the element on the first tape is not in an alternating arrangement with the elements on the second tape. In such an arrangement, the element on the first tape that is not disposed between two elements on the second tape may prevent the slider from passing over the unengaged element or may cause twisting of the stringers relative to the fastening plane if the slider moves past the unengaged element.

The slide fastener may have other non-standard elements that provide a transition between the blocking element and the blocking coupling elements to further couple the stringers together. For example, the first stringer may include first and second end transition elements that engage with standard elements on the second stringer that are adjacent the first and second end transition elements in one of the sliding directions and that engage with the blocking coupling elements on the second stringer that are adjacent the first and second end transition elements.

The slide fastener may also include one or more intermediate transition elements. One or more intermediate transition elements may be disposed on the first stringer between the blocking element and the end transition elements, and one or more intermediate transition elements may be disposed on the second stringer between the blocking coupling elements and the standard elements. The intermediate transition elements may be engaged with the end transition elements, with the blocking coupling elements, and with each other. The intermediate transition elements may be included to increase the length between the end transition elements.

Each element, including the elements described above, includes a base portion and first and second engagement portions. The base portion is coupled to the first and second surfaces of the respective tape. The first and second engagement portions extend from the base portion and the inner edge of the respective tape. The first and second engagement portions are coupled together along the fastening plane. Each engagement portion has a first edge that faces the first sliding direction, a second edge that faces the second sliding direction, and a distal edge that extends between the first and second edges. The distal edge faces the inner edge of the tape opposite the respective tape to which the element is coupled.

FIG. 1 illustrates a slide fastener 10 according to one implementation. The slide fastener 10 includes a first stringer 20, a second stringer 30, and a slider 40. Each stringer 20, 30 includes a tape 21, 31, respectively, and a plurality of elements disposed on an inner edge 23, 33 of the respective tape 21, 31. The tapes 21, 31 lie within a fastening plane P, and the inner edges 23, 33 of the tapes 21, 31 face each other within the fastening plane P.

The slider 40 is slidably coupled to at least one of the stringers 20, 30. The slider 40 couples the plurality of elements of the stringers 20, 30 when the slider 40 is urged in a first sliding direction S1 within the fastening plane P and decouples the plurality of elements when urged in a second sliding direction S2 within the fastening plane P. The second sliding direction S2 is opposite the first sliding direction S1.

Figure 2A:
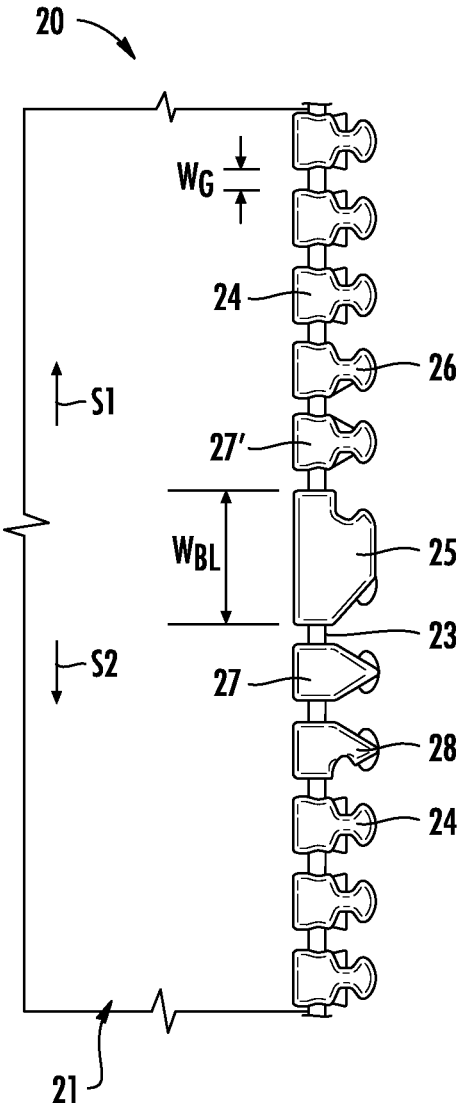
FIGS. 2A and 2B illustrate plan views of the first surfaces of the first and second stringers, respectively, as shown in FIG. 1.
Figure 2B:
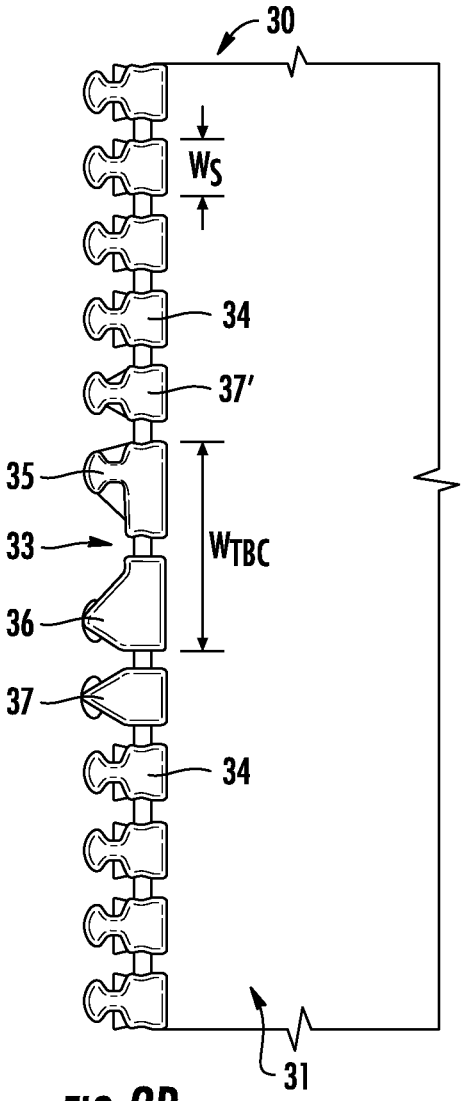
Figure 9:
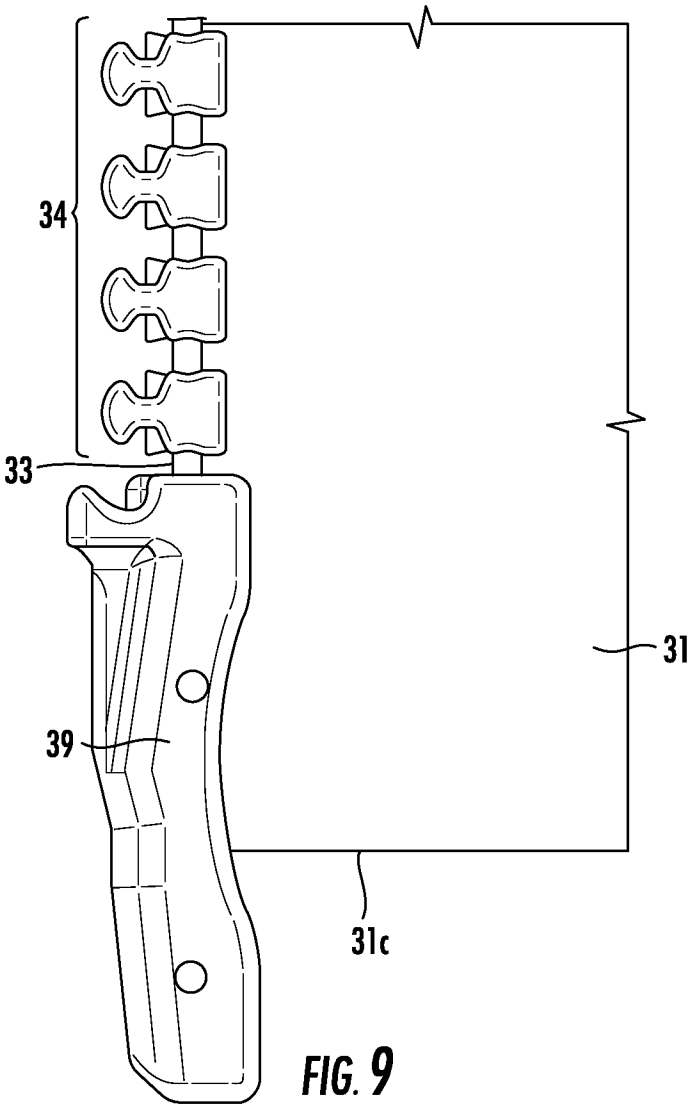
FIG. 9 is a plan view of a first side of a pin coupled to a first end of the second tape as shown in FIG. 1, according to one implementation.
Figure 8:
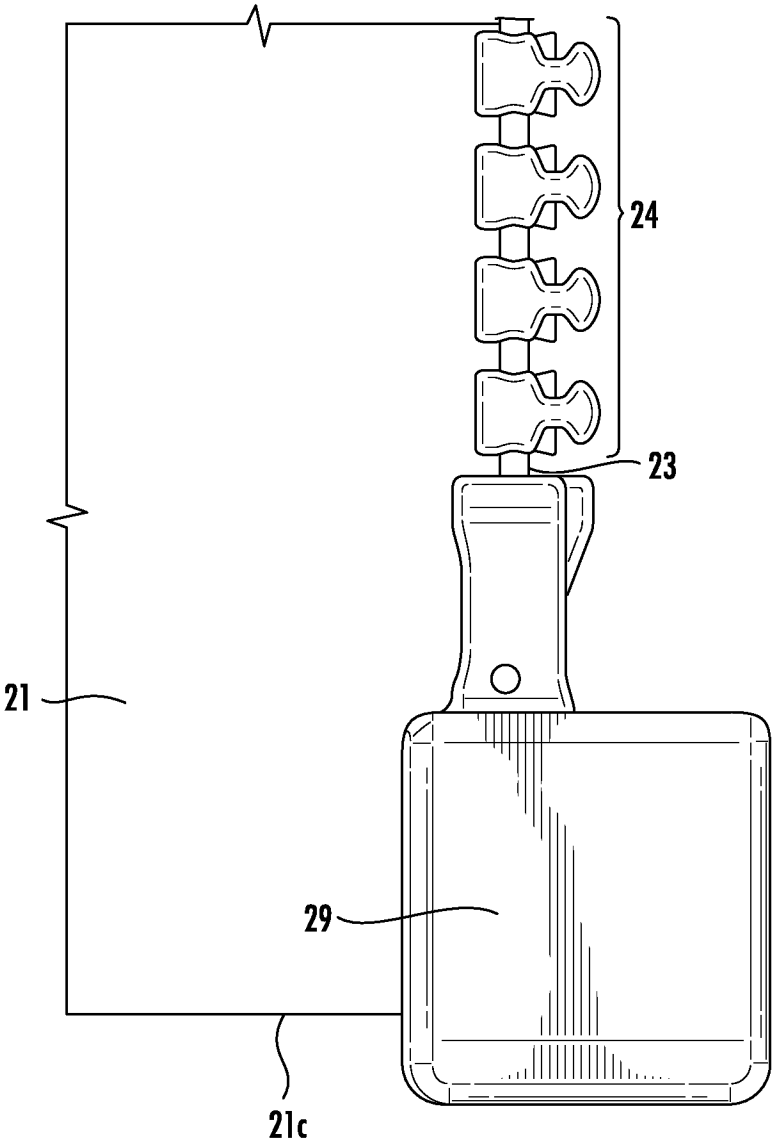
FIG. 8 is a plan view of a first side of a retaining box coupled to a first end of the first tape as shown in FIG. 1, according to one implementation.

As shown in FIGS. 1-2B, the plurality of elements of the first stringer 20 includes a plurality of standard elements 24, a blocking element 25, one or more intermediate transition elements 27, 27', and first and second end transition elements 26, 28. The plurality of elements of the second stringer 30 includes a plurality of standard elements 34, a first blocking coupling element 35, a second blocking coupling element 36, and one or more intermediate transition elements 37, 37'. The first stringer 20 further includes a retaining box 29 coupled to a first end 21*c* of the first tape 21 along the inner edge 23, and the second stringer 30 includes a pin 39 coupled to a first end 31*c* of the second tape 31 along the inner edge 33. The retaining box 29 and pin 39 are also shown in FIGS. 8 and 9, respectively. The pin 39 is slidably engagable through the slider 40 and into the retaining box 29 to couple the first ends 21*c*, 31*c* of the tapes 21, 31. As the slider 40 is urged in the first sliding direction away from the retaining box 29 and pin 39, the slider 40 forces the elements on the tapes 21, 31 to engage each other. Although the retaining box 29 is shown on the first tape 21 and the pin 39 is shown on the second tape 31 in this implementation, the arrangement of the retaining box 29 and pin 39 could be switched such that the retaining box 29 is coupled to the second tape 31 and the pin 29 is coupled to the first tape 21.

In the implementation shown in FIGS. 1-2B, a first set of standard elements 24 are disposed between the retaining box 29 and the second end transition element 28. The intermediate transition element 27 is disposed between the second end transition element 28 and the blocking element 25, and the intermediate transition element 27' is disposed between the blocking element 25 and the first end transition element 26. And, a second set of standard elements 24 are disposed between the first end transition element 26 and a second end 21*d* of the tape 21. A third set of standard elements 34 are disposed between the pin 39 and the intermediate transition element 37. The blocking coupling elements 35, 36 are disposed between the intermediate transition element 37 and the intermediate transition element 37', and the blocking coupling elements 35, 36 are disposed adjacent each other along the inner edge 33 of the tape 31. And, a fourth set of standard elements 34 are disposed between the intermediate transition element 37' and the second end 31*d* of the tape 31.

In other implementations (not shown), one or both stringers 20, 30 may not include intermediate transition elements 27, 27', 37, 37'.

The elements 24, 25, 26, 28, 27, 27' are spaced apart from adjacent elements on the stringer 20 by a gap width $W_G$. In addition, the elements 34, 35, 36, 37, 37' are spaced apart from adjacent elements on the stringer 30 by the gap width $W_G$.

The lengths of each element and the thicknesses of each element are the same. The lengths of each element are measured from a distal edge of the base portion to a distal edge of the engagement portions, and the thicknesses are measured from a first side of the element to a second side of the element. In addition, the distal edges of the base portions of each element on each stringer are at least tangential to respective planes that extends parallel with the sliding directions S1, S2 and each other and orthogonal to the first and second surfaces 21*a*, 21*b*, 31*a*, 31*b* of the tapes 21, 31. Furthermore, the widths of elements 24, 34, 26, 28, 27, 27', 37, and 37' are the same. However, a width $W_{BL}$ of the blocking element 25 is twice the width $W_S$ of element 24 plus the gap width $W_G$ between two adjacent standard elements 24. And, a total width $W_{TBC}$ of the blocking coupling elements 35, 36 plus the gap width $W_G$ between the elements 35, 36 is three times the width $W_S$ of element 24. Thus, the blocking coupling elements 35, 36 replace three standard elements 34 on the second stringer 31, and the blocking element 24 replaces two standard elements 24 on the first stringer 21. However, in other implementations, a width of the blocking element may be selected to replace more than two standard elements and a width of the blocking coupling elements may be selected to replace more than three standard elements.

Figure 10:
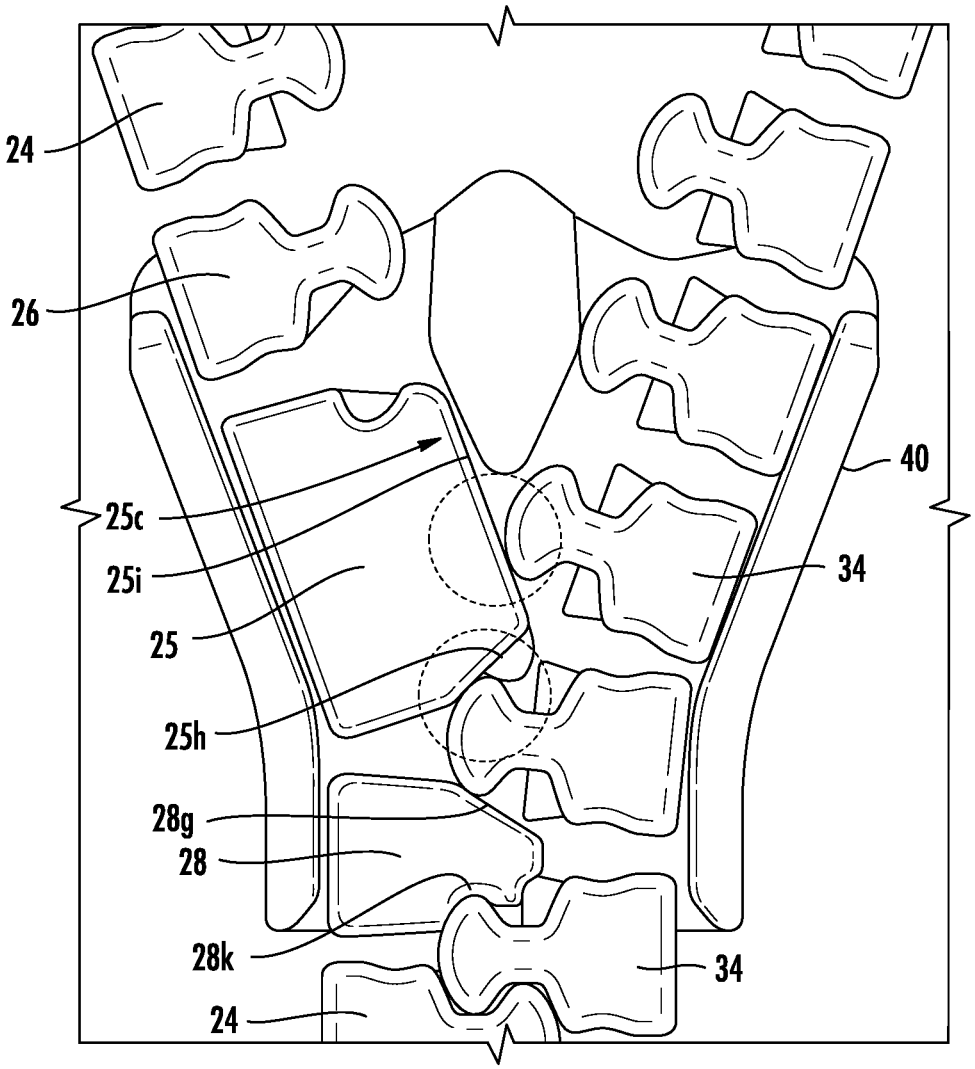
FIG. 10 is a plan view of the interference of the blocking element on the first tape with standard elements on the second tape above a portion of slider 40 that slides over the second surfaces of the tapes and elements. The tapes to which the elements are coupled are not shown in this view so that the relative location of the slider and the elements can be viewed.

As shown in FIGS. 1-4G and 7A-7E, engagement portions 24*b*, 24*c* of at least a portion of the standard elements 24 on the first tape 21 engage between engagement portions (not labeled) of the standard elements 34 on the second tape 31, and vice versa, when the slider 40 is urged over the standard elements 24, 34 in the first sliding direction S1. Engagement portions 25*b*, 25*c* of the blocking element 25 engage between engagement portions 35*c*, 36*b* of the first and second blocking coupling elements 35, 36, respectively, when the slider 40 is urged over the blocking element 25 and blocking coupling elements 35, 36 in the first sliding direction S1. A contour of the blocking element 25 and a contour of the blocking coupling elements 35, 36 are different from a contour of the standard element 24, 34 such that the engagement portions of the standard elements 34 on the second tape 31 do not engage with the engagement portions 25*b*, 25*c* of the blocking element 25 on the first tape 21 in an alternating arrangement, and the engagement portions 24*b*, 24*c* of the standard elements 24 on the first tape 21 do not engage with the engagement portions 35*b*, 35*c*, 36*b*, 36*c* of the blocking coupling elements 35, 36, respectively, on the second tape 31 in an alternating arrangement. When the elements on each tape are properly engaged, the engagement portions of the elements on each tape (except the retaining box element and end stop elements) are disposed in an alternating arrangement with each other in the sliding directions and the fastening planes of the elements are coplanar when the stringer is laid flat. FIG. 10 illustrates the interaction of the blocking element 25 with standard elements 34 within the slider 40. As shown by the dotted circles, engagement portions of the standard element 34 abut the chamfered surface 25*h* and distal edges 25*f*, 25*i* of the blocking element 25, which prevents engagement of standard element 34 with blocking element 25.

Blocking Element

Figure 3B:
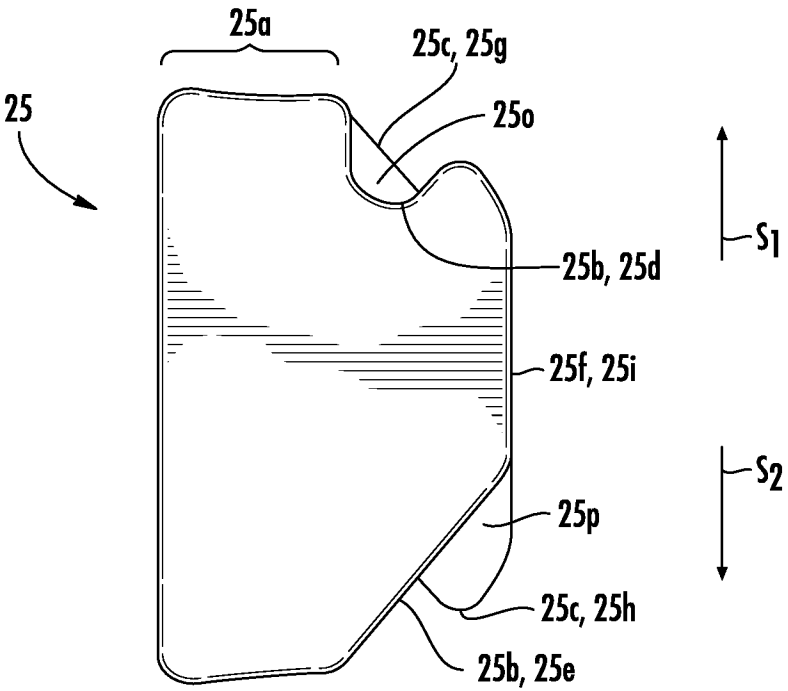
FIG. 3B is a plan view of a first side of the blocking element shown in FIG. 3A. The plan view of a second side of the blocking element shown in FIG. 3A is the same as the plan view of the first side.
Figure 3A:
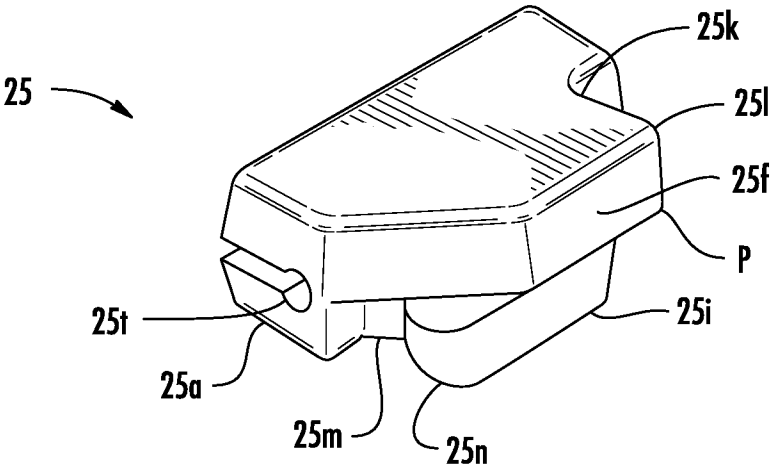
FIG. 3A is a perspective view from a first side of the blocking element shown in FIG. 1, according to one implementation.

Various views of the blocking element 25 are shown in FIGS. 3A-3B. As shown, the blocking element 25 includes a base portion 25*a* and the first and second engagement portions 25*b*, 25*c*. The base portion 25*a* defines a channel 25*t* that receives the inner edge 23 and the first and second surfaces 21*a*, 21*b* of the first tape 21. The base portion 25*a* is coupled to the first and second surfaces 21*a*, 21*b* of the first tape 21, as shown in FIGS. 1-2A. The engagement portions 25*b*, 25*c* extend from the base portion 25*a* and the inner edge 23 of the first tape 21. The first and second engagement portions 25*b*, 25*c* are coupled together along the fastening plane P. As shown in FIG. 3B, each engagement portion 25*b*, 25*c* has a first edge 25*d*, 25*g*, respectively, that faces the first sliding direction S1, a second edge 25*e*, 25*h*, respectively, that faces the second sliding direction S2, and a distal edge 25*f*, 25*i*, respectively, that extends between the respective first and second edges 25*d*, 25*g*, 25*e*, 25*h* and faces the inner edge 33 of the second tape 31. The distal edges 25*f*, 25*i* are planar and intersect at an angle of less than 180 degrees. However, in other implementations, the distal edges 25*f*, 25*i* may intersect at an angle of 180 degrees. And, in other implementations, the distal edges may not be planar.

At least one of the first and/or second edges 25*d*, 25*g*, 25*e*, 25*h* defines a recess and a protrusion. The recess is defined between the base portion 25*a* and the protrusion, and the protrusion is adjacent the respective distal edges 25*f*, 25*i*. In addition, at least one of the other first and/or second edges 25*d*, 25*g*, 25*e*, 25*h* defines a chamfered surface that extends between the base portion 25*a* and the respective distal edges 25*f*, 25*i*. In the implementation shown in FIGS. 3A-3B, the second edge 25*e* of the first engagement portion 25*b* and the first edge 25*g* of the second engagement portion 25*c* each have a chamfered surface that extends between the respective distal edges 25*f*, 25*i* and the base portion 25*a*. The first edge 25*d* of the first engagement portion 25*b* and the second edge 25*h* of the second engagement portion 25*c* each define a respective recess 25*k*, 25*m* and a respective protrusion 25*l*, 25*n*. The recesses 25*k*, 25*m* are defined between the base portion 25*a* and the respective protrusion 25*l*, 25*n*, and the protrusions 25*l*, 25*n* are adjacent the respective distal edges 25*f*, 25*i*.

A portion of the chamfered surface 25*g* extends adjacent a proximal portion of the recess 25*k* and a portion of the chamfered surface 25*e* extends adjacent a proximal portion of the recess 25*m* to define first blocking shoulders 25*o* that extend in the fastening plane P. And, a portion of each protrusion 25*l*, 25*n* extends adjacent a distal portion of the respective chamfered surface 25*g*, 25*e* to define second blocking shoulders 25*p* that extend in the fastening plane P. The blocking shoulders 25*o*, 25*p* abut portions of the engagement portions of adjacent elements on the second tape 31 to prevent the elements from being decoupled from a force applied transversely to the fastening plane P and the sliding directions S1, S2.

Blocking Coupling Elements

Figures 4A, 4B, 4C:
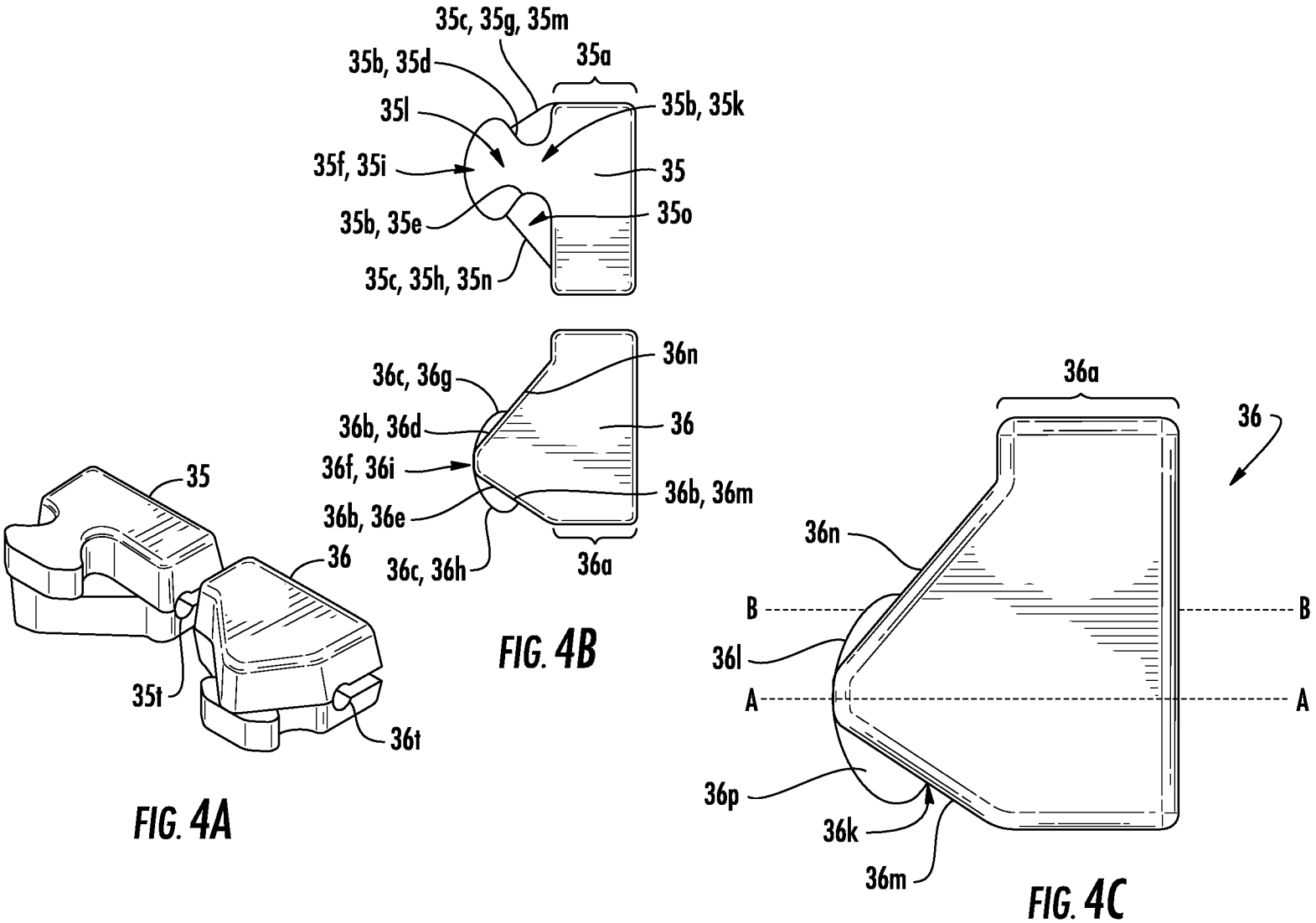
FIG. 4A is a perspective view from a first side of the first and second blocking coupling elements shown in FIG. 1, according to one implementation.
FIG. 4B is a plan view of the first side of the blocking coupling elements shown in FIG. 4A.
FIG. 4C is a close-up plan view of the first side of the second blocking coupling element. The plan view of the second side of the first blocking coupling element is the same as the plan view of the first side of the second blocking coupling element, and the plan view of the second side of the second blocking coupling element is the same as the plan view of the first side of the first blocking coupling element.

Various views of the first and second blocking coupling elements 35, 36 are shown in FIGS. 4A-4C. As shown, each blocking coupling element 35, 36 includes a base portion 35*a*, 36*a*, the first engagement portions 35*b*, 36*b*, and the second engagement portions 35*c*, 36*c*, respectively. Each base portion 35*a*, 36*a* defines a channel 35*t*, 36*t* that receives the inner edge 33 and first and second surfaces 31*a*, 31*b* of the second tape 31. The base portions 35*a*, 36*a* are coupled to the first and second surfaces 31*a*, 31*b* of the second tape 31, as shown in FIGS. 1 and 2B. The engagement portions 35*b*, 35*c*, 36*b*, 36*c* extend from the respective base portion 35*a*, 36*a* and the inner edge 33 of the second tape 31. The first and second engagement portions 35*b*, 35*c*, 36*b*, 36*c* of each blocking coupling element 35, 36, respectively, are coupled together along the fastening plane P. Each engagement portion 35*b*, 35*c*, 36*b*, 36*c* has a first edge 35*d*, 35*g*, 36*d*, 36*g*, respectively, that faces the first sliding direction S1, a second edge 35*e*, 35*h*, 36*e*, 36*h*, respectively, that faces the second sliding direction S2, and a distal edge 35*f*, 35*i*, 36*f*, 36*i*, respectively, that extends between the respective first and second edges 35*d*, 35*g*, 35*e*, 35*h*, 36*d*, 36*g*, 36*e*, 36*h* and faces the inner edge 23 of the first tape 21. The respective distal edges 35*f*, 35*i*, 36*f*, 36*i* are planar and intersect at an angle of less than 180 degrees. However, in other implementations, the distal edges 35*f*, 35*i*, 36*f*, 36*i* may intersect at an angle of 180 degrees. And, in other implementations, the distal edges may not be planar.

In some implementations, at least one of the first engagement portions 35*b*, 36*b* and/or the second engagement portions 35*c*, 36*c* defines a neck portion and a head portion. The neck portion extends between the head portion and the base portion 35*a*, 36*a* and has a width as measured in the sliding directions S1, S2 that is less than a width of the head portion. And, at least one of the other of the first engagement portions 35*b*, 36*b* and/or the second engagement portions 35*c*, 36*c* is triangular shaped. The triangular shaped engagement portion may be asymmetrical and include a long edge and a short edge. The long edge faces the first or second sliding direction S1, S2, and the short edge faces the other of the first or second sliding direction S1, S2. As discussed below in relation to the engagement of the first and second blocking coupling elements 35, 36 with the blocking element 25, a guide portion is continuous with the long edges, which serves to guide the chamfered surfaces 25*e*, 25*g* into abutment with the long edges.

In the implementation shown in FIGS. 1, 2B, and 4A-4C, the first engagement portion 35*b* of the first blocking coupling element 35 and the second engagement portion 36*c* of the second blocking coupling element 36 include a neck portion 35*k*, 36*k* and a head portion 351, 361, respectively. The neck portion 35*k*, 36*k* is disposed between the base portion 35*a*, 36*a* and the head portion 35*l*, 36*l*, respectively. The neck portion 35*k*, 36*k* has a width as measured in the sliding directions S1, S2 that is less than a width of the head portion 35*l*, 36*l*. Because the first side of the first blocking coupling element 35 has the same contour as the second side of the second blocking coupling element 36, and vice versa, only the first sides of the blocking coupling elements 35, 36 are shown in FIGS. 1, 2B, and 4A-4B.

The second engagement portion 35*c* of the first blocking coupling element 35 and the first engagement portion 36*b* of the second blocking coupling element 36 has a triangular shape as viewed from the fastening plane P. The triangular shape of each engagement portion 35*c*, 36*b* is asymmetrical in this implementation. The apex of each triangular shaped engagement portion 35*c*, 36*b* coincides with the respective distal edges 35*i*, 36*f*. Each triangular shaped engagement portion 35*c*, 36*b* includes a long edge 35*n*, 36*n* and a short edge 35*m*, 36*m*. The long edges 35*n*, 36*n* face each other in the sliding directions S1, S2. In particular, the short edge 35*m* is the first edge 35*g* and the long edge 35*n* is the second edge 35*h* of the second engagement portion 35*c* of the first blocking coupling element 35. The short edge 36*m* is the second edge 36*e* and the long edge 36*n* is the first edge 36*d* of the first engagement portion 36*b* of the second blocking coupling element 36. A guide portion, which is continuous with the long edges 35*n*, 36*n*, serves to guide the chamfered surfaces 25*e*, 25*g* of the blocking element 25 into abutment with the long edges 36*n*, 35*n*, respectively.

A plane A extends through the distal edges 35*f*, 35*i*, 36*f*, 36*i* and the base portions 35*a*, 36*a* of each respective blocking coupling element 35, 36 and orthogonal to the first and second surfaces 31*a*, 31*b* of the second tape 31, and a plane B extends through a medial portion of the base portions 35*a*, 36*a* orthogonal to the first and second surfaces 31*a*, 31*b* of the second tape 31. The plane A and the plane B extending through each blocking coupling element 35, 36 are parallel and spaced apart from each other. In particular, the plane A extending through the first blocking coupling element 35 is offset in the first sliding direction S1 from the plane B extending through the first blocking coupling element 35, and the plane A extending through the second blocking coupling element 36 is offset in the second sliding direction S2 from the plane B extending through the second blocking coupling element 36.

First blocking coupling shoulders 35*o* extend in the fastening plane P and are defined by portions of the triangular shaped second engagement portion 35*c* that extend adjacent a proximal portion of the neck portion 35*k* of the first engagement portion 35*b*. And, second blocking coupling shoulders 36*p* extend in the fastening plane P and are defined by portions of the head portion 36*n* of the second engagement portion 36*c* that extends adjacent a distal portion of the triangular shaped first engagement portion 36*b*. First blocking coupling shoulders of the second blocking coupling element 36 and second blocking coupling shoulders of the first blocking coupling element 35 are not shown but are the same as the first and second blocking coupling shoulders 35*o*, 36*p*, respectively. The blocking coupling shoulders, such as first blocking coupling shoulders 35*o* and second blocking coupling shoulders 36*p*, abut portions of the engagement portions of adjacent elements on the first tape 21 to prevent the elements from being decoupled from a force applied transversely to the fastening plane P and the sliding directions S1, S2.

End Transition Elements

Figure 5C:
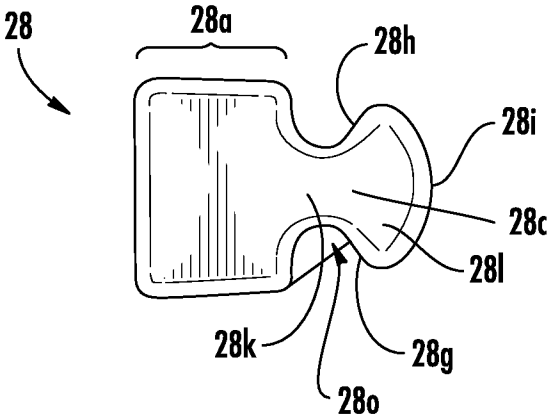
FIG. 5C is a plan view of a second side of the second end transition element shown in FIG. 5A. The plan view of the first side of the first end transition element shown in FIG. 1 is the same as the plan view of the second side of the second end transition element shown in FIG. 5C, and the plan view of the second side of the first end transition element shown in FIG. 1 is the same as the plan view of the first side of the second end transition element shown in FIG. 5B.
Figure 5B:
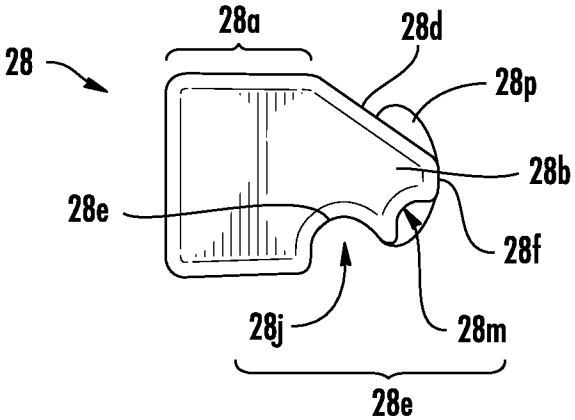
FIG. 5B is a plan view of the first side of the second end transition element shown in FIG. 5A.
Figure 5A:
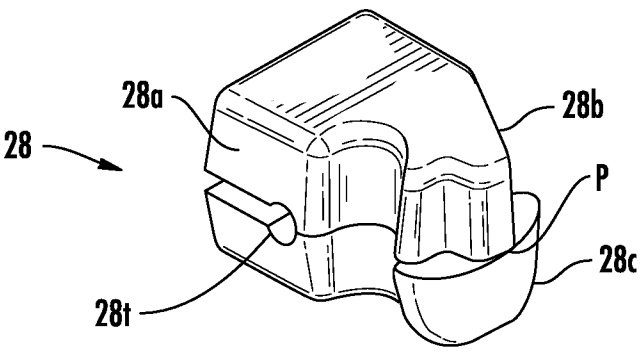
FIG. 5A is a perspective view from a first side of the second end transition element shown in FIG. 1, according to one implementation.

Various views of the second end transition element 28 are shown in FIGS. 5A-5C. Views of the first end transition element 26 are not shown separately because the contour of the first end transition element 26 and the second end transition element 28 are the same. However, the first end transition element 26 is flipped with respect to the fastening plane P relative to the second end transition element 28, as shown in FIGS. 1-2A. In other words, the contour of the first engagement portion of the second end transition element 28, which is disposed on the same side of the fastening plane P as the first surface 21*a* of the tape 21, is the same as the contour of the second engagement portion of the first end transition element 26, which is disposed on the same side of the fastening plane P as the second surface 21*b* of the tape 21, and vice versa. Accordingly, the first and second engagement portions 28*b*, 28*c* of the second end transition element 28 are described below in reference to FIGS. 5A-5C, but it should be understood that these descriptions apply to the second and first engagement portions 26*c*, 26*b*, respectively, of the first end transition element 26.

As shown in FIGS. 2A and 5A-5C, each of the first and second end transition elements 26, 28 include a base portion 26*a*, 28*a* that defines a channel 26*t*, 28*t* that receives the inner edge 23 and first and second surfaces 21*a*, 21*b* of the first tape 21. The base portions 26*a*, 28*a* are coupled to the first and second surfaces 21*a*, 21*b* of the first tape 21, as shown in FIGS. 1 and 2A. The elements 26, 28 also include first and second engagement portions 26*b*, 26*c*, 28*b*, 28*c*.

The first and second engagement portions 28*b*, 28*c* of the second end transition element 28 extend from the base portion 28*a* and the inner edge 23 of the first tape 21. The first and second engagement portions 28*b*, 28*c* are coupled together along the fastening plane P. As shown in FIGS. 5B and 5C, each engagement portion 28*b*, 28*c* has a first edge 28*d*, 28*g*, respectively, that faces the first sliding direction S1, a second edge 28*e*, 28*h*, respectively, that faces the second sliding direction S2, and a distal edge 28*f*, 28*i*, respectively, that extends between the respective first and second edges 28*d*, 28*e*, 28*g*, 28*h*, respectively, and faces the inner edge 33 of the second tape 31. The respective distal edges 28*f*, 28*i* are planar and intersect at an angle of less than 180 degrees. However, in other implementations, the distal edges 28*f*, 28*i* may intersect at an angle of 180 degrees. And, in other implementations, the distal edges may not be planar.

In some implementations, at least one of the first engagement portion 28*b* or the second engagement portion 28*c* defines a neck portion and a head portion. The neck portion extends between the head portion and the base portion 28*a* and has a width as measured in the sliding directions S1, S2 that is less than a width of the head portion. And, the other engagement portion 28*b*, 28*c* defines a chamfered surface and a recess. For example, the first or second edge of the other engagement portion 28*b*, 28*c* may define the chamfered surface and the other of the first or second edge of the other engagement portion may define the recess.

In the implementation shown in FIGS. 5A-5C, the second engagement portion 28*c* includes the head portion 28*l* and the neck portion 28*k*. In addition, the first edge 28*d* of the first engagement portion 28*b* defines a chamfered surface that extends between the base portion 28*a* and the distal edge 28*f* of the first engagement portion 28*b*. The chamfered surface has a slope that corresponds with the slope of the short edge of the triangular shaped first engagement portion 36*b* of the second blocking coupling element 36 and the short edge of the triangular shaped second engagement portion 35*c* of the first blocking coupling element 35. And, the second edge 28*e* of the first engagement portion 28*b* defines a recess 28*j* disposed adjacent the base portion 28*a*. The recess 28*j* defined by the second edge 28*e* aligns with the neck portion 28*k* of the second edge 28*h* of the second engagement portion 28*c*, as shown in FIGS. 5A-5C. In addition, the second edge 28*e* of the first engagement portion 28*b* also defines a shoulder recess 28*m* adjacent the distal edge 28*f*.

A proximal portion of the chamfered surface of the first edge 28*d* of the first engagement portion 28*b* extends adjacent to the portion of the first edge 28*g* of the second engagement portion 28*c* that includes the neck portion 28*k* to define a first end transition shoulder 28*o* in the fastening plane P. In addition, lateral portions of the head portion 28*l* extend adjacent to the portion of the second edge 28*e* of the first engagement portion 28*b* that includes the shoulder recess 28*j* and adjacent to the portion of the first edge 28*d* of the first engagement portion 28*b* that includes a distal portion of the chamfered surface to define a second end transition shoulder 28*p* in the fastening plane P. The end transition shoulders, such as first end transition shoulder 28*o* and second end transition shoulder 28*p*, abut portions of the engagement portions of adjacent elements on the second tape 31 to prevent the elements from being decoupled from a force applied transversely to the fastening plane P and the sliding directions S1, S2.

Intermediate Transition Elements

Figure 6A:
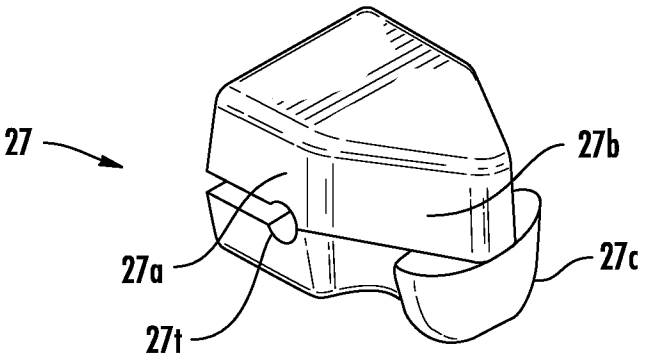
FIG. 6A is a perspective view of a first side the intermediate transition element disposed on the first tape between the second end transition element and the blocking element, as shown in FIGS. 1 and 2A, according to one implementation.
Figure 6B:
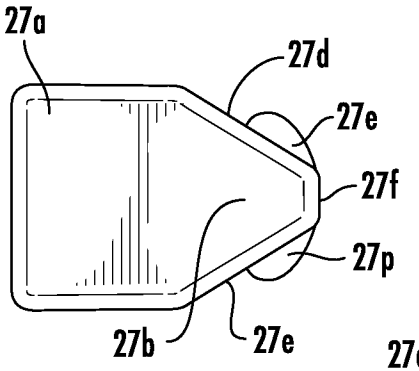
FIG. 6B is a plan view of the first side of the intermediate transition element shown in FIG. 6A.
Figure 6C:
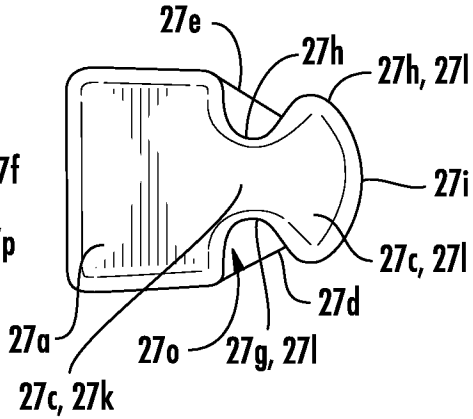
FIG. 6C is a plan view of a second side of the intermediate transition element shown in FIG. 6A. The plan views of the first and second sides of the intermediate transition element disposed on the second tape adjacent the second blocking coupling element in the second sliding direction, as shown in FIGS. 1 and 2B, are the same as the plan views of the first and second sides of the intermediate transition element shown in FIGS. 6B and 6C, respectively. The plan views of the first and second sides of intermediate transition element disposed on the first tape adjacent the blocking element in the first sliding direction as shown in FIGS. 1 and 2A are the same as the plan views of the second and first sides of the intermediate transition element shown in FIGS. 6C and 6B, respectively. And, the plan views of the first and second sides of intermediate transition element disposed on the second tape adjacent the first blocking coupling element in the first sliding direction as shown in FIGS. 1 and 2B are the same as the plan views of the second and first sides of the intermediate transition element shown in FIGS. 6C and 6B, respectively.

Various views of an intermediate transition element 27 that is disposed on the first tape 21 between the second end transition element 28 and the blocking element 25 are shown in FIGS. 6A-6C. Intermediate transition element 27', which is disposed on the first tape 21 between the blocking element 25 and the first end transition element 26, intermediate transition element 37, which is disposed adjacent the second edges 36*e*, 36*h* of the second blocking coupling element 36, and intermediate transition element 37', which is disposed adjacent the first edges of the first blocking coupling element 35, are not shown or described separately from intermediate transition element 27 because the contours of the elements 27, 27', 37, 37' are the same. However, the intermediate transition elements 27, 27' are disposed on the first tape 21, and the intermediate transition elements 37, 37' are disposed on the second tape 31. In addition, the orientation of the elements 27', 37' are flipped with respect to the fastening plane P as compared to elements 27, 37. In other words, the contour of the first engagement portions of intermediate transition elements 27, 37 are the same as the contour of the second engagement portions of intermediate transition elements 27', 37'. Furthermore, although only one of each intermediate transition element 27, 27', 37, 37' is shown in FIGS. 1-2B, more than one of each intermediate transition element 27, 27', 37, 37' may be included on the respective stringer 20, 30 depending on the spacing desired between the first and second end transition elements 26, 28 and the blocking element 25.

As shown in FIGS. 1-2A and 6A-6C, the intermediate transition element 27 includes a base portion 27*a* that defines a channel 27*t* that receives the inner edge 23 and first and second surfaces 21*a*, 21*b* of the first tape 21. The base portion 27*a* is coupled to the first and second surfaces 21*a*, 21*b* of the first tape 21. As shown in FIGS. 6A-6C, the element 27 also includes first and second engagement portions 27*b*, 27*c*.

The first and second engagement portions 27*b*, 27*c* extend from the base portion 27*a* and the inner edge 23 of the first tape 21. The first and second engagement portions 27*b*, 27*c* are coupled together along the fastening plane P. As shown in FIGS. 6B and 6C, each engagement portion 27*b*, 27*c* has a first edge 27*d*, 27*g*, respectively, that faces the first sliding direction S1, a second edge 27*e*, 27*h*, respectively, that faces the second sliding direction S2, and a distal edge 27*f*, 27*i*, respectively, that extends between the respective first and second edges 27*d*, 27*e*, 27*g*, 27*h*, respectively, and faces the inner edge 33 of the second tape 31. The respective distal edges 27*f*, 27*i* are planar and intersect at an angle of less than 180 degrees. However, in other implementations, the distal edges 27*f*, 27*i* may intersect at an angle of 180 degrees. And, in other implementations, the distal edges are not planar.

The first engagement portion 27*b* of the intermediate transition element 27 is triangular shaped. In the implementation shown, the triangular shape is an isosceles triangle. Each edge 27*d*, 27*e* of the first engagement portion 27*b* has a slope that corresponds to the slope of the chamfered surface of the end transition elements 26, 28 and the short edge 35*m*, 36*m* of the triangular engagement portion 35*c*, 36*b* of the first and second blocking coupling elements 35, 36, respectively. However, the slope of the edges 27*d*, 27*e* of the first engagement portion 27*b* does not correspond to the slope of the long edge 35*n*, 36*n* of the triangular engagement portion 35*c*, 36*b* of the first and second blocking coupling elements 35, 36, respectively.

The second engagement portion 27*c* includes a head portion 27*l* and a neck portion 27*k*. The neck portion 27*k* is disposed between the base portion 27*a* and the head portion 27*l* and has a width as measured in the sliding directions S1, S2 that is less than a width of the head portion 27*l*.

Proximal portions of the first and second edges 27*d*, 27*e* of the first engagement portion 27*b* extend adjacent to the portions of the first and second edges 27*g*, 27*h* of the second engagement portion 27*c* that define the neck portion 27*k* to define first intermediate transition shoulders 27*o* in the fastening plane P. In addition, distal portions of the first and second edges 27*g*, 27*h* of the second engagement portion 27*c* that include lateral edges of the head portion 27*l* extend adjacent to distal portions of the first and second edges 27*d*, 27*e* of the triangular shaped first engagement portion 27*b* to define second intermediate transition shoulders 27*p* in the fastening plane P. The first intermediate transition shoulders 27*o* and second intermediate transition shoulders 27*p* abut portions of the engagement portions of adjacent elements on the second tape 31 to prevent the elements from being decoupled from a force applied transversely to the fastening plane P and the sliding directions S1, S2.

Standard Elements

Figure 7B:
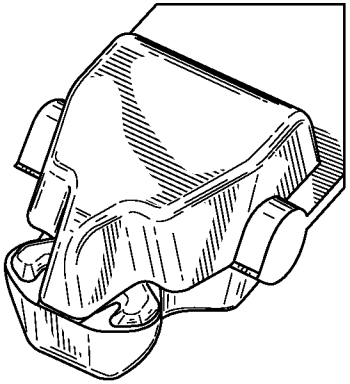
FIG. 7B is a perspective view of a standard element according to another implementation.
Figure 7A:
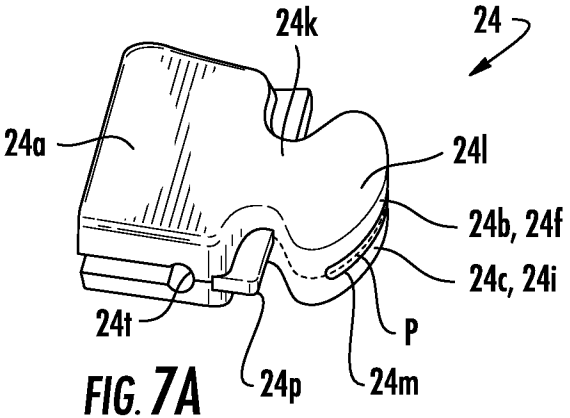
FIG. 7A is a perspective view from a first side of a standard element disposed on the first tape as shown in FIG. 1, according to one implementation. A second side of the standard element shown in FIG. 7A is the same as the first side.

Standard element 24 that is disposed on the first tape 21 is shown in FIG. 7A. All standard elements 24 and 34 have the same contour. Thus, additional standard elements 24 and standard elements 34 are not shown or described separately from element 24 shown in FIG. 7A.

As shown in FIGS. 1-2A and 7A, the standard element 24 includes a base portion 24*a* that defines a channel 24*t* that receives the inner edge 23 and first and second surfaces 21*a*, 21*b* of the first tape 21. The base portion 24*a* is coupled to the first and second surfaces 21*a*, 21*b* of the first tape 21.

As shown in FIG. 7A, the standard element 24 also includes first and second engagement portions 24*b*, 24*c*. The first and second engagement portions 24*b*, 24*c* extend from the base portion 24*a* and the inner edge 23 of the first tape 21. The first and second engagement portions 24*b*, 24*c* are coupled together along the fastening plane P. Each engagement portion 24*b*, 24*c* has a first edge that faces the first sliding direction S1, a second edge that faces the second sliding direction S2, and a distal edge 24*f*, 24*i*, respectively, that extends between the respective first and second edges 24*d*, 24*e*, 24*g*, 24*h*, respectively, and faces the inner edge 33 of the second tape 31. The respective distal edges 24*f*, 24*i* are generally planar. The distal edges 24*f*, 24*i* define a groove 24*m* along the fastening plane P at an interface of the distal edges 24*f*, 24*i*.

Each of the first engagement portion 24*b* and the second engagement portion 24*c* of the standard element 24 includes a head portion 24*l* and a neck portion 24*k*. The neck portion 24*k* is disposed between the base portion 24*a* and the head portion 24*l* and has a width as measured in the sliding directions S1, S2 that is less than a width of the head portion 24*l*. Respective first edges 24*d*, 24*g*, second edges 24*e*, 24*h*, and distal edges 24*f*, 24*i* align with each other.

The standard element 24 also includes a shoulder 24*p* that extends in the fastening plane P between the base portion 24*a* and a portion of the neck portion 24*k* of each engagement portion 24*b*, 24*c*. The groove 24*m* of the standard element 24 receives the shoulder of an adjacent element 34 on the second stringer 30 when the standard elements 24, 34 are coupled together, and vice versa. The engagement of the shoulder and the groove prevents the elements from being decoupled from a force applied transversely to the fastening plane P and the sliding directions S1, S2. In addition, the shoulder recess of each end transition element 26, 28, receives the shoulder of the standard element 34 with which the end transition element 26, 28 is coupled.

In other implementations, the standard elements used on each stringer may have different shaped engagement portions than are shown for standard elements 24, 34 in FIGS. 1, 2A, 2B, and 7A. For example, FIG. 7B illustrates a standard element that may be used with slide fastener 10 in lieu of standard elements 24 and 34, according to some implementations. As another example, the standard elements in some implementations may be shaped like intermediate transition elements 27, 27', 37, 37' shown in FIGS. 1, 2A-2B, and 6A-6C.

Alternative Implementations of Blocking Elements and Blocking Coupling Elements

Figure 11A:
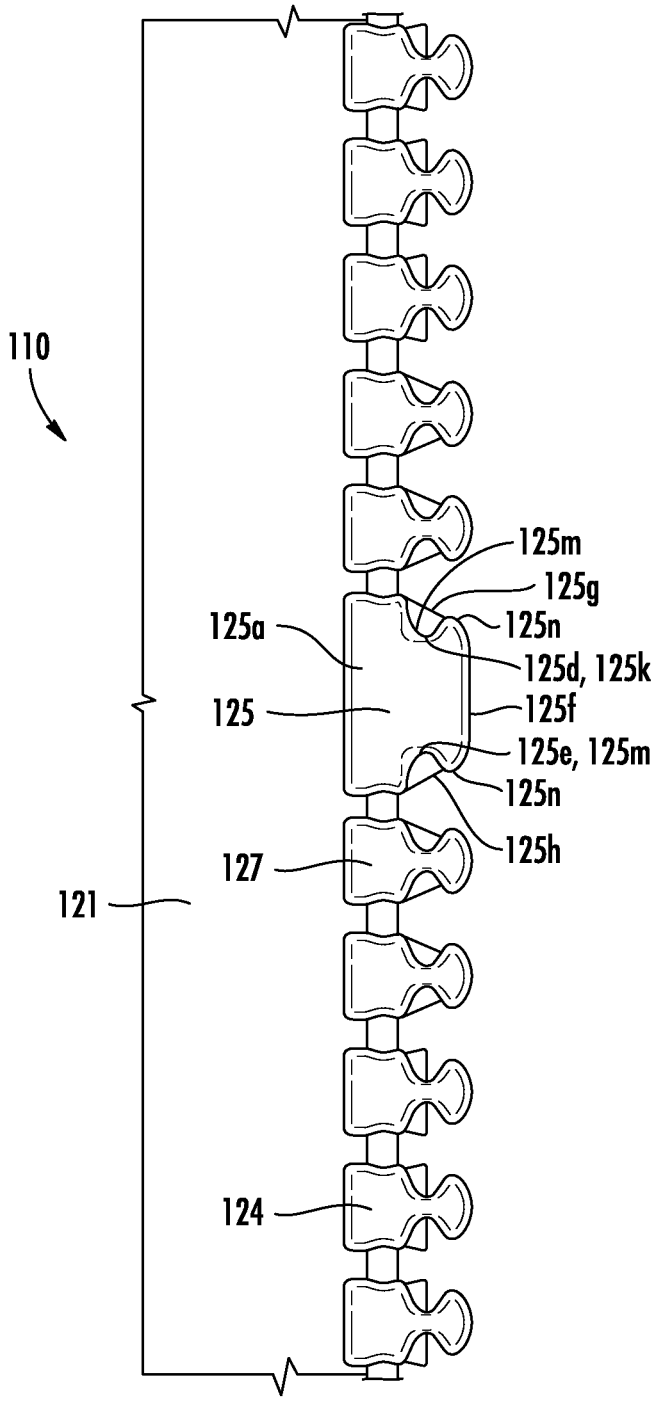
FIGS. 11A and 11B illustrate plan views of the first surfaces of the first and second stringers of a slide fastener according to another implementation.
Figure 11B:
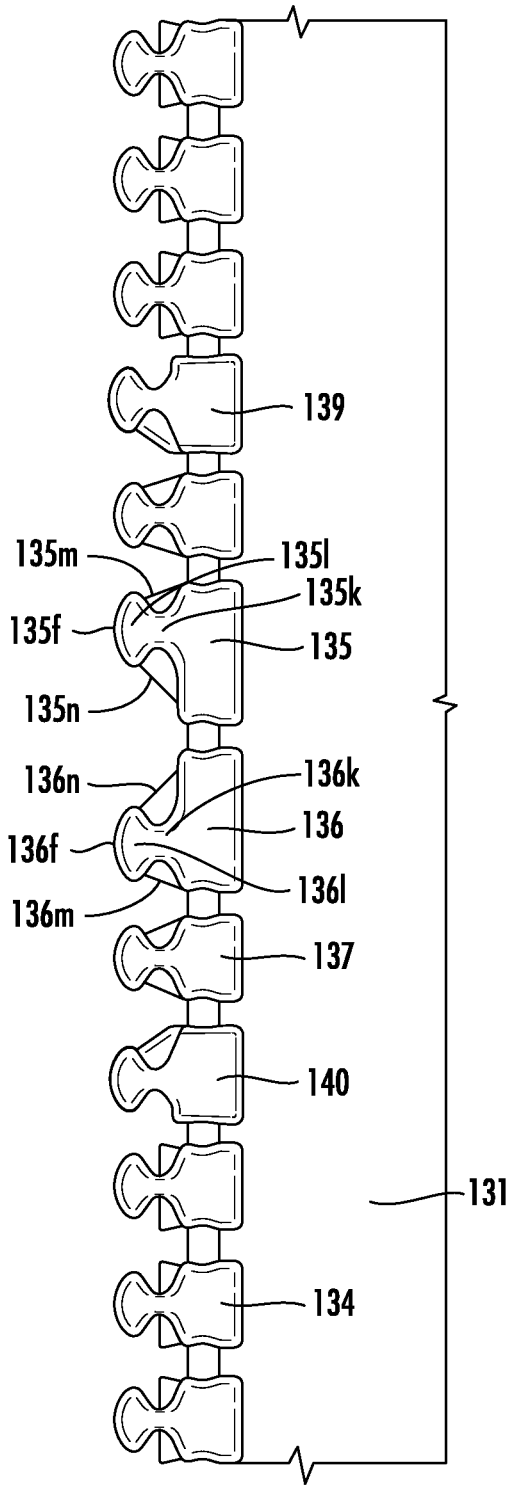

FIGS. 11A-11B illustrate a slide fastener 110 according to another implementation. The slide fastener 110 is similar to the slide fastener 10 described above, but the contour of the engagement portion of the blocking element 125 is different than the contour of the engagement portion of the blocking element 25. In particular, the first engagement portion of the blocking element 125 includes first and second edges 125*d*, 125*e* that each define a recess 125*m* and a protrusion 125*n*. The recesses 125*m* extend between the base portion 125*a* and the protrusions 125*n*, and the protrusions 125*n* are adjacent the distal edge 125*f* of the first engagement portion. The second engagement portion of the blocking element 125 includes first and second edges 125*g*, 125*h* that define chamfered surfaces that extend between the base portion 125*a* and the distal edge of the second engagement portion. The blocking coupling elements 135, 136 each include first engagement portions that include a head portion 135*l*, 136*l* and a neck portion 135*k*, 136*k*. The neck portion 135*k*, 136*k* extends between the base portion 135*a*, 136*a* and the head portion 135*l*, 136*l*, respectively. The second engagement portions of each blocking coupling element 135, 136 have an asymmetrical triangular shape, similar to the blocking coupling elements 35, 36 described above. A short edge 135*m* of the second engagement portion of the first blocking coupling element 135 faces the first sliding direction S1, and the short edge 136*m* of the second engagement portion of the second blocking coupling element 136 faces the second sliding direction S2. The first tape 121 also includes standard elements 124 and intermediate transition elements 127 between the ends of the tape 121 and the blocking element 125, and the second tape 131 includes standard elements 134 and intermediate transition elements 137 between the ends of the tape 131 and the blocking coupling elements 135, 136. The second tape 131 also includes end transition elements 139, 140 that are between intermediate transition elements 137 and standard elements 134. However, in other implementations, the tapes may not include end transition elements.

Figure 12A:
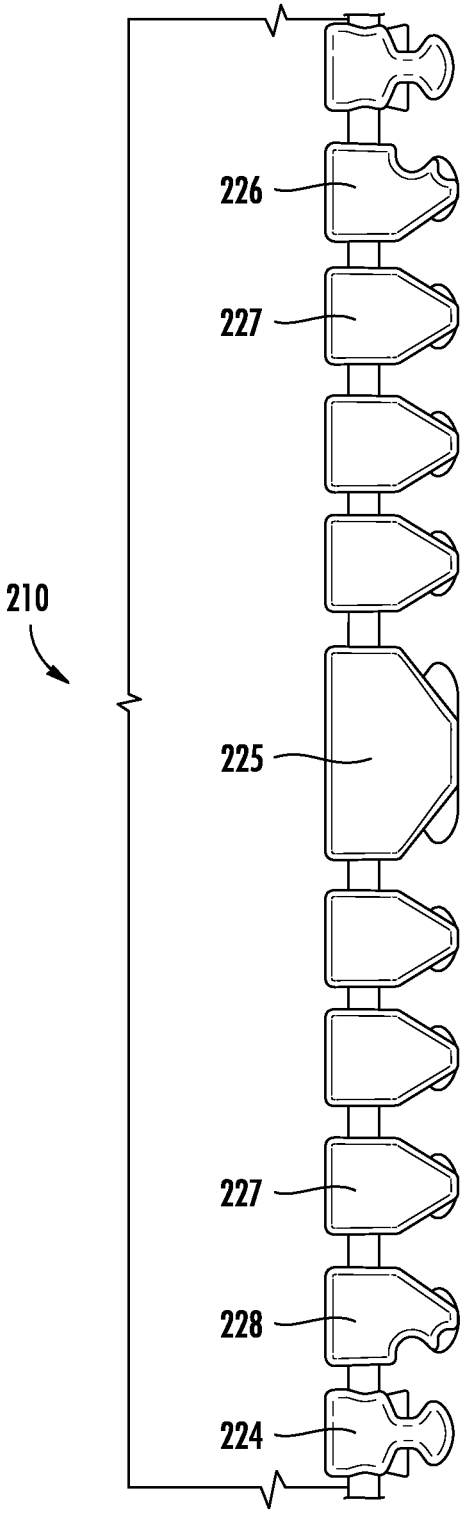
FIGS. 12A and 12B illustrate plan views of the first surfaces of the first and second stringers of a slide fastener according to yet another implementation.
Figure 12B:
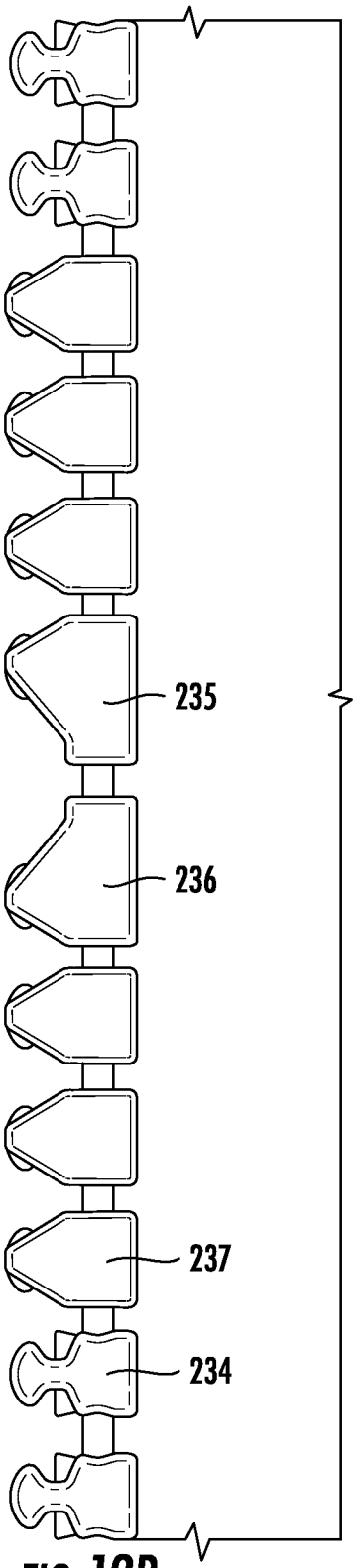

FIG. 12A-12B illustrates a slide fastener 210 according to yet another implementation. In this implementation, the contour of the blocking element 225 is the same as the contour of the blocking element 125 shown in FIG. 11A, but the orientation of the blocking element 225 is flipped relative to the fastening plane P as compared to the blocking element 125. In other words, the contour of the first engagement portion of the blocking element 125 is the same as the contour of the second engagement portion of the blocking element 225, and the contours of the first engagement portions of the blocking coupling elements 135, 136 are the same as the contours of the second engagement portions of the blocking coupling elements 235, 236. The stringer to which the blocking element 225 is coupled also includes one or more intermediate transition elements 227 immediately adjacent the blocking element 225 in each sliding direction, standard elements 224 adjacent the ends of the tape, and end transition elements 226, 228 between the intermediate transition elements 227 and the standard elements 224. And, the stringer to which the blocking coupling elements 235, 236 are coupled include intermediate transition elements 237 immediately adjacent the first blocking coupling element 235 in the first sliding direction and immediately adjacent the second blocking coupling element 236 in the second sliding direction and standard elements 234 between the intermediate coupling elements 237 and the ends of the stringer.

Operation and Methods of Use

As shown in FIGS. 1-2B, to couple the first stringer 20 and the second stringer 30, the pin 39 is inserted through the slider 40 and the retaining box 29. Then, the slider 40 is urged in the first sliding direction S1 through the fastening plane P. As the slider 40 is urged along the fastening plane P, the engagement portions of the elements on each stringer 20, 30 pass through the slider 40 and couple with the engagement portions of the elements that are on the opposite stringer and are adjacent the respective element in each sliding direction.

As noted above, the contour of the blocking element 25 and a contour of the blocking coupling elements 35, 36 are different from a contour of the standard element 24, 34 such that the engagement portions of the standard elements 34 on the second tape 31 do not engage with the engagement portions 25*b*, 25*c* of the blocking element 25 on the first tape 21 in an alternating arrangement, and the engagement portions 24*b*, 24*c* of the standard elements 24 on the first tape 21 do not engage with the engagement portions 35*b*, 35*c*, 36*b*, 36*c* of the blocking coupling elements 35, 36, respectively, on the second tape 31 in an alternating arrangement. However, the engagement portions 25*b*, 25*c* of the blocking element 25 and the second and first edges 35*e*, 35*h*, 36*d*, 36*g* of the engagement portions 35*b*, 35*c*, 36*b*, 36*c* of the blocking coupling elements 35, 36, respectively, can be engaged together in an alternating arrangement. This arrangement allows the stringers 20, 30 to be coupled together but prevents a stringer without the blocking coupling elements from being coupled to the stringer with blocking element, and vice versa.

In particular, when the slider 40 is urged over the blocking element 25 and blocking coupling elements 35, 36 in the first sliding direction S1, first edges 25*d*, 25*g* of the blocking element 25 engage the second edges 35*e*, 35*h* of the first blocking coupling element 35 and second edges 25*e*, 25*h* engage the first edges 36*d*, 36*g* of the second blocking coupling element 36. The distal edges 25*f*, 25*i* are disposed adjacent the base portions 35*a*, 36*a* of the blocking coupling elements 35, 36. In addition, the first edges 35*d*, 35*g* of the first blocking coupling element 35 engage the second edges of the intermediate transition element 27'. And, the second edges 36*e*, 36*h* of the second blocking coupling element 36 engage the first edges 27*d*, 27*g* of the intermediate transition element 27. And the second edges 27*e*, 27*h* of the intermediate transition element 27 engage the first edges of the intermediate transition element 37. The second edges of the intermediate transition element 37 engage the first edges 28*d*, 28*g* of the second end transition element 28. And, the second edges 28*e*, 28*h* of the second end transition element 28 engage the first edges of standard element 34. The second edges of standard element 34 engage the first edges 24*d*, 24*g* of standard element 24. Furthermore, the first edges of intermediate transition element 27' engage the second edges of the intermediate transition element 37', the first edges of the intermediate transition element 37' engage the second edges of the first end transition element 26, the first edges of the first end transition element 26 engage the second edges of standard element 34, and the first edges of standard element 34 engage the second edges of standard element 24.

In implementations in which one or more intermediate transition elements 27, 27', 37, 37' are not included, the respective edges of the blocking coupling elements and the end transition elements are engaged directly.

In addition, each stringer may be provided separately with a particular product for coupling with the other stringer, which may have been previously provided. For example, the slide fastener may be useful for joining portions of a cover together. In applications in which a portion of the cover to which the first or second stringer is attached is replaceable, coupling stringers of a slide fastener according to the above implementations to a base and the cover deters the use of replacement covers that do not include these stringers.

In the following description, specific details are set forth describing some implementations consistent with the present disclosure. Numerous specific details are set forth to provide a thorough understanding of the implementations. It will be apparent, however, to one skilled in the art that some implementations may be practiced without some or all of these specific details. The specific implementations disclosed herein are meant to be illustrative but not limiting. One skilled in the art may realize other elements that, although not specifically described here, are within the scope and the spirit of this disclosure. In addition, to avoid unnecessary repetition, one or more features shown and described in association with one implementations may be incorporated into other implementations unless specifically described otherwise or if the one or more features would make an implementation non-functional.

In some instances well known methods, procedures, and components have not been described in detail so as not to unnecessarily obscure aspects of the implementations.

The invention claimed is:

1. A slide fastener comprising:

first and second stringers, each stringer comprising a tape and a plurality of elements disposed on an inner edge of the tape, the tape being within a fastening plane, and the inner edges facing each other within the fastening plane, a slider slidably coupled to at least one of the stringers, the slider coupling the plurality of elements of the stringers when the slider is urged in a first sliding direction within the fastening plane and decoupling the plurality of elements when urged in a second sliding direction within the fastening plane, the second sliding direction being opposite the first sliding direction, wherein:

the plurality of elements of the first stringer and the second stringer comprises a plurality of standard elements, the plurality of elements of the first stringer further comprises a blocking element, the plurality of elements on the second stringer further comprises first and second blocking coupling elements, engagement portions of at least a portion of the standard elements on the first tape engage between engagement portions of at least a portion of the standard elements on the second tape in an alternating arrangement in the sliding directions, and vice versa, when the slider is urged over the standard elements in the first sliding direction, engagement portions of the blocking element engage between engagement portions of the first and second blocking coupling elements when the slider is urged over the blocking element and the blocking coupling elements in the first sliding direction, and a contour of the blocking element and a contour of the blocking coupling elements are different from a contour of the standard element such that the engagement portions of the standard elements on the second tape do not engage with the engagement portions of the blocking element on the first tape in an alternating arrangement in the sliding directions, and the engagement portions of the standard elements on the first tape do not engage with the engagement portions of the blocking coupling elements on the second tape in an alternating arrangement in the sliding directions, wherein the engagement portions of the blocking element comprise a first engagement portion and a second engagement portion, the first and second engagement portions extend from the inner edge of the first tape and the base portion of the blocking element and are coupled together along the fastening plane, each engagement portion having a first edge that faces the first sliding direction, a second edge that faces the second sliding direction, and a distal edge that extends between the first and second edges and faces the inner edge of the second tape, the first edge of the first engagement portion of the blocking element defines a first recess and protrusion, and the second edge of the first engagement portion of the blocking element defines a first chamfered surface, the first edge of the second engagement portion of the blocking element defines a second chamfered surface, and the second edge of the second engagement portion of the blocking element defines a second recess and protrusion.

2. The slide fastener of claim 1, wherein each element has a base portion coupled to first and second surfaces of the respective tape, and the base portions of adjacent elements on each tape are spaced apart along the respective tape by a gap width.

3. The slide fastener of claim 2, wherein:

the base portion of the blocking element has a blocking base width as measured in the sliding directions, the base portion of each standard element has a standard base width as measured in the sliding directions, and the blocking base width is at least twice the standard base width plus the gap width.

4. The slide fastener of claim 3, wherein a width of the base portions of the first and second blocking coupling elements and the gap width therebetween is at least three times the standard base width plus twice the gap width.

5. The slide fastener of claim 1, wherein the engagement portions of the blocking element comprise a first engagement portion and a second engagement portion, the first and second engagement portions extend from the inner edge of the first tape and the base portion of the blocking element and are coupled together along the fastening plane, each engagement portion having a first edge that faces the first sliding direction, a second edge that faces the second sliding direction, and a distal edge that extends between the first and second edges and faces the inner edge of the second tape, at least one of the first edges of the blocking element defining a recess and protrusion, and at least one of the second edges of the blocking element defining a chamfered surface that extends between the base portion of the blocking element and the respective distal edge of the engagement portions of the blocking element.

6. The slide fastener of claim 5, wherein a first engagement portion of each blocking coupling element defines a neck portion and a head portion, and a second engagement portion of each blocking coupling element has a triangular shape as viewed from the fastening plane.

7. The slide fastener of claim 6, wherein the triangular shape is asymmetrical, the triangular shape comprising a long edge and a short edge, the long edge facing one of the first or second sliding direction, and the short edge facing the other of the first or second sliding direction.

8. The slide fastener of claim 7, wherein each of the first and second blocking coupling element has a guide portion that is continuous with the long edge.

9. The slide fastener of claim 1, wherein the plurality of elements further comprises at least one intermediate transition element and/or at least one end transition element.

10. The slide fastener of claim 9, wherein a first engagement portion of each end transition element defines a chamfered surface and a recess, and a second engagement portion of each end transition element defines a neck portion and a head portion.

11. The slide fastener of claim 10, wherein each engagement portion of each end transition element comprises a first edge and a second edge, the first edges facing the first sliding direction, and the second edges facing the second sliding direction, wherein one of the first or second edges of the respective engagement portion of each end transition element defines the chamfered surface and the other of the first or second edges of the respective engagement portion of each end transition element defines the recess.

12. The slide fastener of claim 9, wherein one engagement portion of each intermediate transition element defines a triangular shape as viewed from the fastening plane, and another of engagement portion of each intermediate transition element defines a neck portion and a head portion.

13. The slide fastener of claim 1, wherein the first tape comprises a retaining box or a pin coupled to an end of the first tape along the inner edge of the first tape, and the second tape comprises the other of a retaining box or a pin coupled to an end of the second tape along the inner edge of the second tape, wherein the pin is engaged through the slider and into the retaining box, and the slider is movable in the first sliding direction away from the engaged retaining box and pin and ends of the tapes to engage the plurality of elements.

14. A stringer for use in a slide fastener, the stringer comprising:

a tape and a plurality of elements disposed on an edge of the tape, the tape being within a fastening plane, each of the plurality of elements comprising a base portion and first and second engagement portions, the base portion being coupled to first and second surfaces of the tape, and the first and second engagement portions extending from the base portion and the edge of the tape, the first and second engagement portions being coupled together along the fastening plane, the plurality of elements comprises a plurality of standard elements, the plurality of elements further comprises a blocking element, a contour of the engagement portions of the blocking element are different from a contour of the engagement portions of the standard element such that the engagement portions of the standard elements on another tape do not engage with the engagement portions of the blocking element in an alternating arrangement, and at least one of the engagement portions of the blocking element has a chamfered surface, wherein the first and second engagement portions of the blocking element each have a first edge, a second edge, and a distal edge, the first and second edges extending between the base portion and the distal edge, the first edge of the first engagement portion defines a first recess and protrusion, the second edge of the first engagement portion defines a first chamfered surface, the first edge of the second engagement portion defines a second chamfered surface, and the second edge of the second engagement portion defines a second recess and protrusion, wherein each chamfered surface extends between the base portion of the blocking element and the distal edge of the blocking element.

15. The stringer of claim 14, wherein a slider is slidably coupled to the stringer, the slider being slidable in a first sliding direction and a second sliding direction along the edge of the tape.

16. The stringer of claim 14, wherein the base portions of adjacent elements on the tape are spaced apart along the respective tape by a gap width.

17. The stringer of claim 16, wherein:

the base portion of the blocking element has a blocking base width as measured in the sliding directions, the base portion of each standard element has a standard base width as measured in the sliding directions, and the blocking base width is at least twice the standard base width plus the gap width.

18. The stringer of claim 14, wherein the plurality of elements comprises at least one end transition element, one of the first or second engagement portion of each end transition element defines a chamfered surface and a recess, and the other of the first or second engagement portion of each end transition element defines a neck portion and a head portion.

19. The stringer of claim 18, wherein one of the first or second edges of the respective first or second engagement portion of each end transition element defines the chamfered surface, and the other of the first or second edges of the respective first or second engagement portion of the respective end transition element defines the recess.

20. The stringer of claim 19, wherein the plurality of elements comprises at least one intermediate transition element, one of the first or second engagement portion of each intermediate transition element defines a triangular shape as viewed from the fastening plane, and the other of the first or second engagement portion of each intermediate transition element defines a neck portion and a head portion.

21. The stringer of claim 14, wherein the tape comprises a retaining box or a pin along the edge of the tape adjacent an end of the tape.

22. A stringer for use in a slide fastener, the stringer comprising:

a tape and a plurality of elements disposed on an edge of the tape, the tape being within a fastening plane, each of the plurality of elements comprising a base portion and first and second engagement portions, the base portion being coupled to first and second surfaces of the tape, and the first and second engagement portions extending from the base portion and the edge of the tape, the first and second engagement portions being coupled together along the fastening plane, the plurality of elements comprises a plurality of standard elements, the plurality of elements further comprises first and second blocking coupling elements, a contour of the engagement portions of the blocking coupling elements are different from a contour of the engagement portions of the standard elements such that the engagement portions of the standard elements on another tape do not engage with the engagement portions of the blocking coupling elements in an alternating arrangement, and at least one of the engagement portions of the blocking coupling elements has a chamfered surface, wherein one of the first or second engagement portion of each blocking coupling element defines a neck portion and a head portion, and the other of the first or second engagement portion of each blocking coupling element has a triangular shape as viewed from the fastening plane, and wherein the triangular shape is asymmetrical, the triangular shape comprising a long edge and a short edge, the long edge facing one of the first or second sliding direction, and the short edge facing the other of the first or second sliding direction.

23. The stringer of claim 22, wherein a slider is slidably coupled to the stringer, the slider being slidable in a first sliding direction and a second sliding direction along the edge of the tape.

24. The stringer of claim 22, wherein the base portions of adjacent elements on the tape are spaced apart along the respective tape by a gap width.

25. The stringer of claim 24, wherein:

the base portion of each standard element has a standard base width as measured in the sliding directions, and a total base width of the base portions of the first and second blocking coupling elements and the gap width therebetween is at least three times the standard base width plus twice the gap width.

26. The stringer of claim 22, wherein each of the first and second blocking coupling element has a guide portion that is continuous with the long edge.

27. The stringer of claim 22, wherein the plurality of elements comprises at least one end transition element, one of the first or second engagement portion of each end transition element defines a chamfered surface and a recess, and the other of the first or second engagement portion of each end transition element defines a neck portion and a head portion.

28. The stringer of claim 27, wherein one of the first or second edges of the respective first or second engagement portion of each engagement portion of each end transition element defines the chamfered surface, and the other of the first or second edges of the respective first or second engagement portion of the respective end transition element defines the recess.

29. The stringer of claim 22, wherein the plurality of elements comprises at least one intermediate transition element, one of the first or second engagement portion of each intermediate transition element defines a triangular shape as viewed from the fastening plane, and the other of the first or second engagement portion of each intermediate transition element defines a neck portion and a head portion.

30. The stringer of claim 22, wherein the tape comprises a retaining box or a pin along the edge of the tape adjacent an end of the tape.

* * * * *